US006551218B2

(12) United States Patent
Goh

(10) Patent No.: US 6,551,218 B2
(45) Date of Patent: Apr. 22, 2003

(54) DEEP STRIDE EXERCISE MACHINE

(75) Inventor: Yong Goh, Laverne, CA (US)

(73) Assignee: Unisen, Inc., Irvine, CA (US)

( * ) Notice: Subject to any disclaimer, the term of this patent is extended or adjusted under 35 U.S.C. 154(b) by 0 days.

(21) Appl. No.: 09/559,167

(22) Filed: Apr. 26, 2000

(65) Prior Publication Data

US 2002/0198083 A1 Dec. 26, 2002

Related U.S. Application Data

(60) Provisional application No. 60/131,064, filed on Apr. 26, 1999.

(51) Int. Cl.[7] ..... A63B 22/00
(52) U.S. Cl. ..... 482/52; 482/51; 482/57
(58) Field of Search ..... 482/51, 52, 53, 482/57, 70, 79, 80, 96; 434/255

(56) References Cited

U.S. PATENT DOCUMENTS

| | | | | |
|---|---|---|---|---|
| 3,316,898 A | | 10/1964 | Brown | |
| 3,759,511 A | | 9/1973 | Zinkin et al. | |
| 4,679,786 A | | 7/1987 | Rodgers | |
| 4,685,666 A | | 8/1987 | DeCloux | |
| 4,709,918 A | | 12/1987 | Grinblat | |
| 4,733,858 A | | 3/1988 | Lan | |
| 4,989,957 A | | 2/1991 | Kuo | |
| 5,242,343 A | | 9/1993 | Miller | |
| 5,279,529 A | | 1/1994 | Eschenbach | |
| 5,299,993 A | | 4/1994 | Habing | |
| 5,499,956 A | | 3/1996 | Habing et al. | |
| 5,518,473 A | | 5/1996 | Miller | |
| 5,577,985 A | | 11/1996 | Miller | |
| 5,707,321 A | | 1/1998 | Maresh | |
| 5,792,029 A | | 8/1998 | Gordon | |
| 5,792,028 A | * | 12/1998 | Jarvie | 482/51 |
| 5,876,307 A | * | 3/1999 | Stearns et al. | 482/51 |
| 5,876,308 A | * | 3/1999 | Jarvie | 482/51 |
| 6,019,710 A | * | 2/2000 | Dalebout et al. | 482/70 |
| 6,183,397 B1 | * | 2/2001 | Stearns et al. | 482/52 |

* cited by examiner

*Primary Examiner*—Stephen R. Crow
(74) *Attorney, Agent, or Firm*—Knobbe, Martens, Olson & Bear, LLP

(57) ABSTRACT

A lower body exercise machine has a pair of laterally spaced apart foot members. The foot members are coupled to a frame which supports the exercise machine. First and second guide linkages are pivotally connected to the frame. First and second articulating linkages are pivotally connected to each corresponding guide linkages and to a pair of crank arms. The foot members are pivotally connected to the articulating linkages. The size, shape and connection between the various components and linkages is such that each foot member guides the foot of a user along a preferred anatomical deep stride path simulative of natural running motion.

10 Claims, 7 Drawing Sheets

DEEP STRIDE EXERCISE MACHINE

This application claims the benefit of Provisional application Ser. No. 60,131,064 filed Apr. 26, 1999.

BACKGROUND OF THE INVENTION

1. Field of the Invention

The present invention relates to an exercise apparatus for providing simulated walking or running motion and, in particular, a simple, compact exercise apparatus for producing a deep stride natural running motion using a combination of pins, linkages and gears.

2. Description of the Related Art

The benefits of regular exercise to improve overall health, fitness and longevity are well documented in the literature. Medical science has consistently demonstrated the improved strength, health, and enjoyment of life which results from physical activity. Aerobic exercises, such as jogging and walking, are particularly popular and medically recommended exercises for conditioning training and improving overall health and cardiovascular efficiency.

However, modern lifestyles often fail to accommodate accessible running or walking areas. In addition, inclimate weather and other environmental and social factors may cause individuals to remain indoors as opposed to engaging in outdoor physical activities.

There are also certain dangers and/or health risks associated with walking, jogging or running on natural outdoor surfaces. For example, medical experience has demonstrated that knee and ankle joints are often strained or injured when joggers run on paved or uneven surfaces or jogging paths which change direction often. Other examples of common injuries resulting from jogging, particularly on uneven terrain, may include foot sores, pulled or strained muscles, strained tendons and cartilage, back injuries, and head injuries, not to mention the risk of physical harm from pedestrian crossing accidents or even criminal activity. Thus, many exercise enthusiasts prefer the safety and convenience of an in-home or commercial exercise machine in order to provide desired exercise without the attendant inconvenience and risk of outdoor exercise.

Presently available indoor exercise devices for commercial or home use come in a wide variety of sizes and configurations. Typical indoor exercise devices may include, for example, stationary bicycles for simulating bicycle pedaling action, simulated stepping machines for simulating or replicating the motion associated with stair stepping exercise, and treadmills for simulating running, jogging, or walking. Other popular exercise devices include ski simulators and a wide variety of weight lifting or resistance training exercise equipment.

Each of these exercise machines has particular advantages and disadvantages for accomplishing a desired fitness goal. For example, treadmills generally permit a user to walk, jog or run on a stationary platform or endless belt. As such, treadmills are particularly well suited for general fitness and endurance training. However, the foot impact associated with walking or running may be undesirable in some cases due to advanced age, pregnancy, or other health conditions. In those cases it may be beneficial for the user to engage in a more low impact or non-impact exercise.

Cycling simulators, ski simulators, and stair simulators are particularly noted for the elimination of impacts affecting the hips, knees, ankles, and feet of a user. However, such exercise machines have a limited range of motion such that certain muscle groups are often not fully exercised to the degree desired by the user. In particular, these machines do not faithfully reproduce what many consider to be the most natural and beneficial exercise motions—namely, walking and running.

More recently, elliptical foot path exercise devices have been introduced into the market and have become popular for both home and commercial use. These devices provide a broader range of foot motion generally tracing a path approximating an ellipse or modified ellipse. For example, U.S. Pat. No. 5,299,993 to Stearns shows a modified stair stepping exercise machine which incorporates both vertical and horizontal movement using a combination of linkages to guide the foot pedals in an elliptical or ovate path. Habing in U.S. Pat. Nos. 5,299,993 and 5,499,956 provides articulated linkages controlled through cables by motor to move the foot pedals through an open ovate path. Both devices guide the foot pedals using linkages and rollers operating against a linear guide track.

Like Stearns and Habing, most elliptical path exercise machines utilize a linear guide track to produce the desired elliptical path foot motion. There are several disadvantages associated with such linear guide tracks. Guide tracks, by their nature, tend to make noise when in use due to a bearing or wheel riding back and forth along a track. The track is usually open to accommodate linear motion of the bearing and dust, dirt and grime can accumulate in the track causing noise and undue wear and tear. This can result in significant upkeep and repair to maintain such devices in good working order. Also, the open configuration of the track and the need for lubrication of the track and bearing provides for the possibility of inadvertent exposure of the user or other adjacent surface to greasy or oily stains. In carpeted areas, for example, an open lubricated track can result in difficult-to-remove stains in the underlying carpet.

Linear guide tracks also tend to produce a relatively shallow elliptical running path that is less simulative of the desired natural deep running stride. A deeper running stride is preferred because it is more simulative of the natural running motion and also results in more thorough exercise of the legs and musculature of the lower body of the user. For optimal deep stride running simulation, preferably the overall vertical component of the elliptical foot path displacement is between about one-half to two-thirds of the overall horizontal foot path displacement per cycle.

Elliptical exercise machines utilizing guide tracks rely on the reciprocating back-and-forth motion of the guide-track/bearing system to achieve the desired elliptical foot path motion. This back-and-forth motion tends to impart a jerkiness or discontinuity in the velocity or acceleration of the users foot as it moves along the elliptical path. It is unavoidable that the various moving components comprising the guide track and bearing must have a certain mass and, thus, the dynamics and changing velocities and accelerations of the individual components can often impart to the exercise machine an undesirable uneven stride motion or "kick". This can make the device more difficult to use and decrease the smoothness and non-impact gliding ability of the exercise machine. Excessive acceleration of particularly massive linkages can cause undesired torsional or bending strain within associated support and pivot members, increasing wear and the risk of potential catastrophic failure.

Some of these deleterious effects can be attenuated by increasing the size of a flywheel mass associated with the exercise machine. But this adds weight and cost to the machine and often does not eliminate the jerkiness of the guide path mechanism to the extend desired.

Another drawback of many conventional elliptical path exercise machines is the relatively large amount of space occupied by the machine's "foot-print." The foot-print is the amount of floor area an exercise machine occupies when properly set up, giving due consideration for any additional clearances required for safe operation of the machine and for ingress and egress of users. Smaller foot-print machines are more desirable for commercial use, such as in gyms, health spas and the like, because of the cost of renting and maintaining commercial floor space.

Notably, many of the prior art elliptical exercise devices utilize foot pedals that are rigidly attached to extended foot linkages. These foot linkages, in turn, are provided in connected relationship between a crank at one end and a guide or reaction roller at the other end. Therefore, in a conventional elliptical exercise machine the longest dimension of the machine's foot print typically extends well beyond the major axis of the elliptical foot path. This is due to the fact that the axis of the crank as it turns a wheel or other device when considered with the axis of the connection at the end of the crank limits the overall stroke distance to the working diameter of the crank or twice the crank arm length, which forms the major axis of the elliptical path. Also, the bearing or reaction roller is typically required to be situated well rearward of the foot linkage in order to provide the desired amount of vertical displacement in the elliptical path motion.

For example to achieve a sixteen inch length in the major axis of the elliptical footpath of a conventional elliptical path trainer, the crank of the trainer needs to have a longer crank arm length than half the length which would be eight inches. This takes into account the journaling and bearing mountings. From a practical standpoint in order to provide a sixteen inch length of the major axis of the elliptical path, a nine inch long crank must be utilized to provide approximately an eighteen inch diameter circle. In addition, the foot linkage may extend another twenty-four to thirty-six inches rearward beyond the point of attachment to the crank to engage a guide roller. Thus, the total displacement of the crank and linkage required to achieve a sixteen inch running stride could be as long as forty to fifty inches or more. This translates into an undesirably large or elongated foot print relative to the length of the stride path achieved.

SUMMARY OF THE INVENTION

Accordingly, it is a principle object and advantage of the present invention to overcome some or all of these limitations by providing an improved elliptical path exercise machine having a deep stride foot path, that is simple and robust in its construction, requires minimal maintenance, provides smooth even exercise motion, and which has a compact foot-print.

In accordance with one embodiment the present invention provides a lower body cardiovascular exercise machine having a pair of laterally spaced apart foot members. The foot members are coupled to a frame which supports the exercise machine. A first and second guide linkage is pivotally connected to the frame. A first and second articulating linkage is pivotally connected to the guide linkages and a pair of crank arms, respectively. The foot members are pivotally connected to the articulating linkages. By this design, the foot members guide the feet of the user along a preferred deep stride running motion.

In accordance with another embodiment the present invention provides a lower body exercise machine, including a frame configured to be supported by a surface, the frame having a first and a second pivot axis defined thereon and a crank rotatable about the first axis and having a crank arm. A guide linkage is provided having a first and a second end. The guide linkage is pivotally connected to the second axis proximate the first end. An articulating linkage is provided having a first and a second end. The first end of the articulating linkage is pivotally connected to the second end of the guide linkage proximate the first end. The second end of the articulating linkage pivotally is connected to the crank arm between the first and second end. A foot member is provided and pivotally connected proximate the second end of the articulating linkage. The size, shape and connection between the various components and linkages is such that each foot member guides the foot of a user along a preferred anatomical deep stride path simulative of natural running motion.

In accordance with another embodiment the present invention provides a lower body exercise machine including a frame configured to be supported by a surface. The frame includes a first and a second pivot axis defined thereon and a first and second crank each rotatable about the first axis and having a crank arm. First and second guide linkages are provided each having a first and a second end. The guide linkages are pivotally connected to the second axis proximate the first end. First and second articulating linkages are provided each having a first and a second end. The first end of each articulating linkage pivotally connects to the second end of each corresponding guide linkage the first end. The second end of each articulating linkage pivotally connects to the crank arms between the first and second end. First and second foot members are provided pivotally connected proximate the second end of each of the articulating linkages. The size, shape and connection between the various components and linkages is such that each foot member guides the foot of a user along a preferred anatomical deep stride path simulative of running motion.

In accordance with another embodiment the present invention provides an exercise apparatus including a frame and a first crank rotatably connected to the frame defining a first axis. A first link is provided rotatably connected to the crank at the first axis and extending from the first axis to define a second axis radially displaced from the first axis. A second link is provided rotatably connected to the first link at the second axis and extending from the second axis to define and third and fourth axis radially displaced from the second axis. A first foot pedal is pivotally connected to the second link at the third axis to support the foot of a user. A resistance means is operatively connected with the crank to provide exercise resistance.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

A full and adequate understanding of the present invention and the benefits and advantages deriving therefrom may be gained from the following detailed description having reference to the attached figures, of which.

DETAILED DESCRIPTION OF THE PREFERRED EMBODIMENTS

Figure 1:
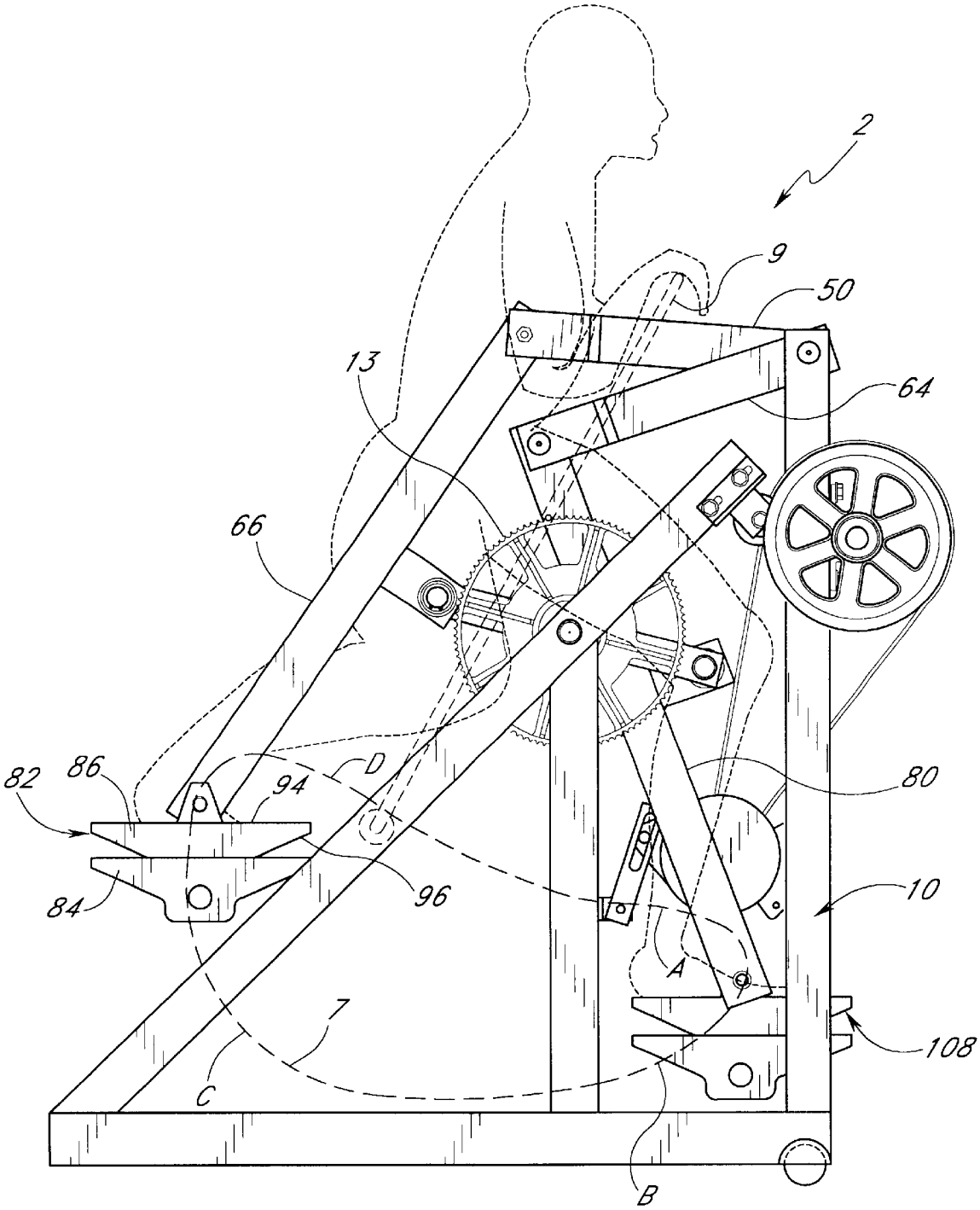
FIG. 1 is a simplified side schematic view of a deep stride elliptical exercise machine having features in accordance with one preferred embodiment of the present invention.

FIG. 1 is a simplified side schematic view of a lower body exercise machine 2 having features in accordance with the present invention. The machine generally comprises a frame 10, a pair of guide linkages 50, 64 a pair of articulating linkages 66, 80, and a pair of foot members 82, 108. The frame 10 is configured to be supported by a substantially planar support surface, such as a floor. Guide linkages 50, 64 are pivotably secured to the frame 10, as shown. Linkages 66 and 80 are pivotably connected to the ends of each of the linkages 50, 64, respectively. A portio of each linkage 66, 80 extends from approximately the middle and pivotably connects the linkage 66, 80 to a crank 13. Foot members 82, 108 depend from each linkage 66, 80 and are pivotably secured thereto, as shown, so as to provide a range of rocking motion.

A user 6 employs the exercise machine 2 by standing on the foot pedals 82, 108 and applying downward pressure to set the machine into motion. The size, shape and orientation of the various linkages and the crank wheel are such that as the machine is set into motion by a user, the user's feet follow an anatomically desirable deep stride foot path, as indicated by the dashed line 7, simulative of a natural running motion. The path of travel generally resembles a kidney bean shape which typifies a deep, anatomically natural running or walking motion of a user. From position A to position B, the first foot member 82 follows a generally semicircular path as the foot member changes from an forward direction to a rearward direction. From position B to position C, the path of travel follows a generally large arcing path. From position C to position D, the foot member 82 generally follows a semicircular path and changes from a rearward to a forward direction as it moves upward to position D. From position D back to position A, the path of travel follows a generally straight or gentle curvilinear path.

This preferred anatomical running motion is continued as the user 6 either runs or walks with their feet placed on the foot members 82, 108. The illustrated foot path is more simulative of a natural running motion. The particular size and shape of the deep stride foot path is determined by a number of controlled parameters, such as the size and relationship between the various linkages and the size of the crank to which they are connected. Optionally, a pair of arm linkages 9 (illustrated in phantom) may be added to the exercise machine 2 in suitable engagement with one or more of the associated linkages to provide a range of desired arm motion.

The various elements of the exercise machine 2 may be constructed from one or more suitable strong and durable materials such as aluminum, steel, plastics, composites or other suitable materials. Elongated linkage members can take the form of any variety of cross-sectional shapes to provide strength to the exercise machine such as square, rectangular, circular, oval, T-beam, I-beam or the like. They may also be solid, hollow or a combination thereof, as desired, given due consideration to the goal of providing a low-cost, low-maintenance machine. Also, the elongated members may be linear, curved or curvilinear depending on the particular requirements of the member. For purposes of example only, the illustrated embodiment shows the elongated members as being generally rectangular, hollow, linear members.

The elongated linkage members may be coupled to various other elements by a suitable coupling member. These coupling members can be embodied as any one of a variety of suitable devices commonly known to one skilled in the art to perform their structural function of coupling various elements, such as a pin, bolt, clamp, clip, post, combinations thereof or the like. Moreover, the coupling members can be formed from any of a variety of cross-sectional shapes, such as a such as a square, rectangular, circular, oval, T-beam. I-beam or the like, and may be solid, hollow or a combination thereof. Also, the interior or exterior surface of the coupling members may be smooth, threaded (to mate with another threaded member), or include one or more protrusions or recesses (to mate with an inversely protruded or recessed member). For purposes of example only, the illustrated embodiment shows the coupling members as being generally cylindrical, solid, smooth linear members.

The coupling members are preferably sized and shaped to form a close-fit relationship with the elements which they couple. This close-fit relationship inhibits slippage among the coupling members to the coupled elements while allowing the coupling members to perform the structural function of securely coupling the elements without unduly restricting movement of the coupling members.

The illustrated embodiments show the coupling members as being generally cylindrical, thus, in the event that a coupling member is passed through a hole, void or aperture of a coupled element, it is understood that the hole, void or aperture is generally circular to match the configuration of the coupling member and provide the desired close-fit relationship of the coupling member with respect to the coupled element. However, as will be understood by one skilled in the art, the hole, void or aperture in the coupled element may also be configured in any of a variety of cooperating geometries to perform the intended function of the coupling element.

Optionally, the foot members 82, 108 may be configured to rock back and forth to provide a limited range of angular displacement. For example, foot member 82 may include a lower plate 84 and an upper plate 86. The upper plate forms an inverted triangle when viewed in cross section (Z—Z axis) and is sized and shaped to support a foot of the user. The upper plate 86 has a top surface 94 which is preferably generally flat and rectangular, however, other designs such as an oval, foot shape or the like may be used. The upper plate 86 also has a bottom surface 96 with a ridgeline that extends along its lateral length. The ridgeline forms a front taper which runs from the ridgeline to the proximal end of the upper plate 86, and a rear taper which runs from the ridgeline to the distal end of the upper plate 86. The upper plate 86 is pivotally connected to the articulating linkage 66 proximate the ridgeline. Pivoting movement of the upper plate 86 is thus constrained by contact with the lower plate 84. The lower plate is preferably fixed in relation to the articulating linkage 66.

Figure 2:
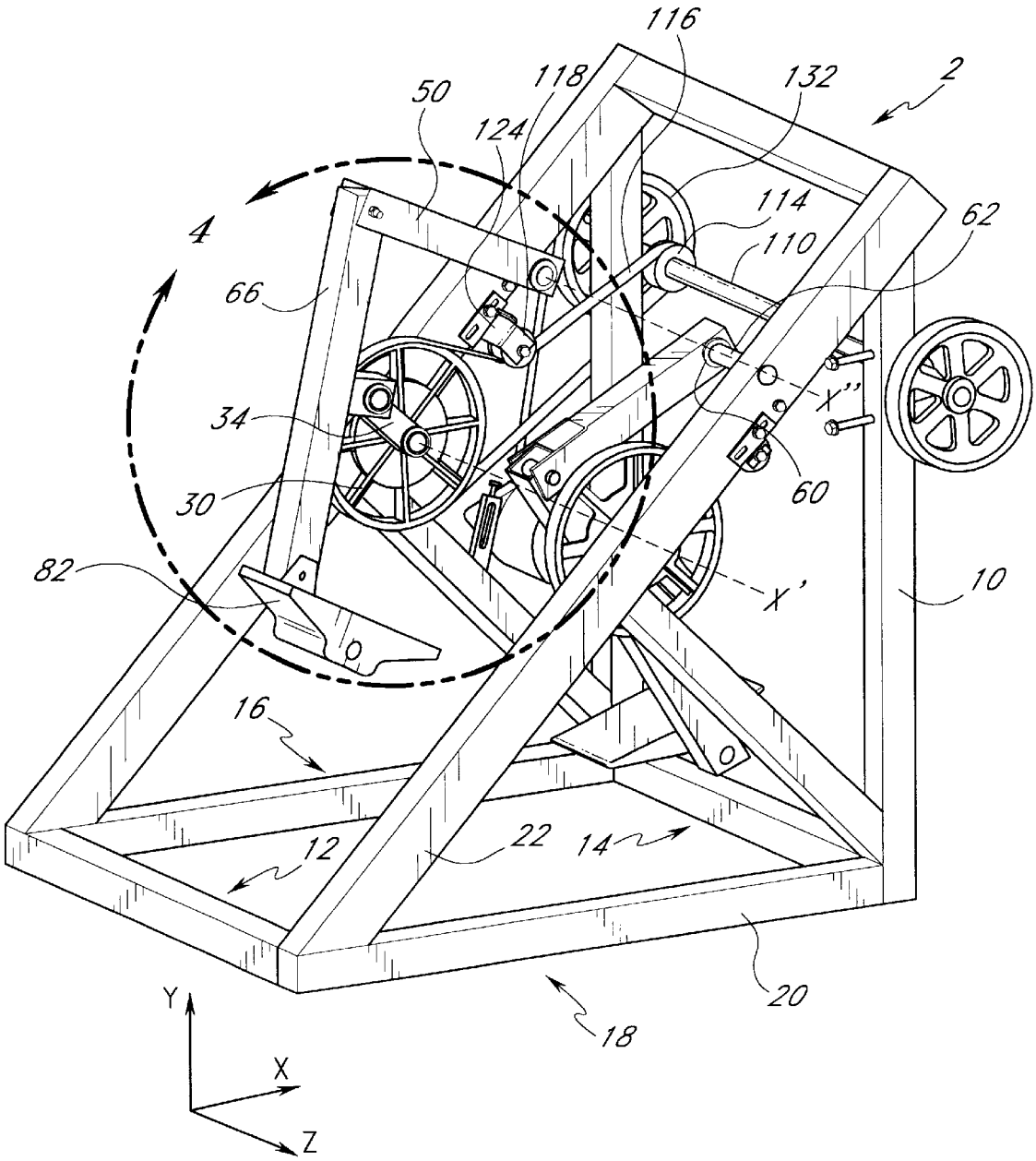
FIG. 2 is a right, front perspective view of a deep stride elliptical exercise machine having features in accordance with another preferred embodiment of the present invention.
Figure 3:
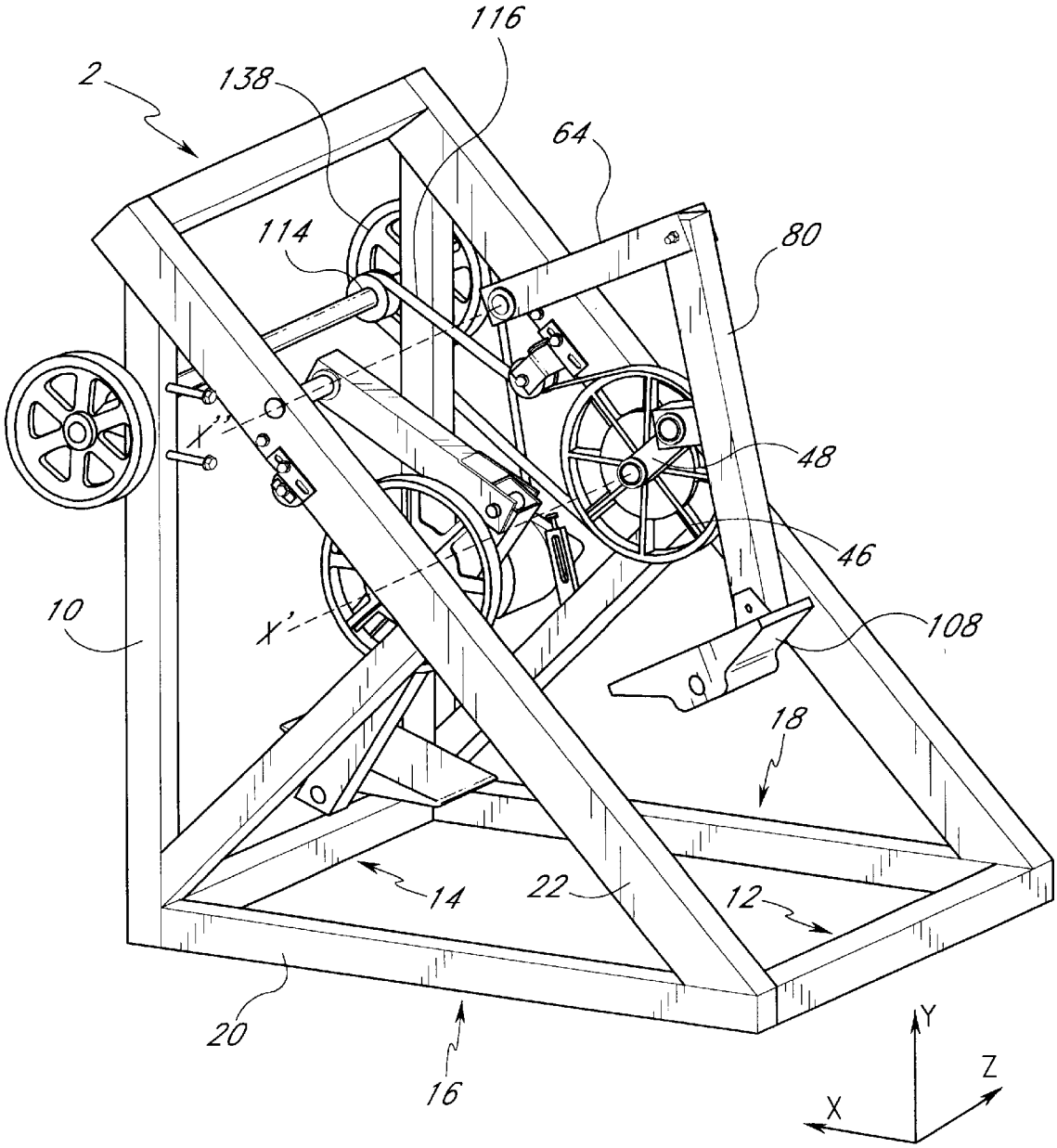
FIG. 3 is a left, front perspective view of the exercise machine illustrated in FIG. 2.
Figure 4:
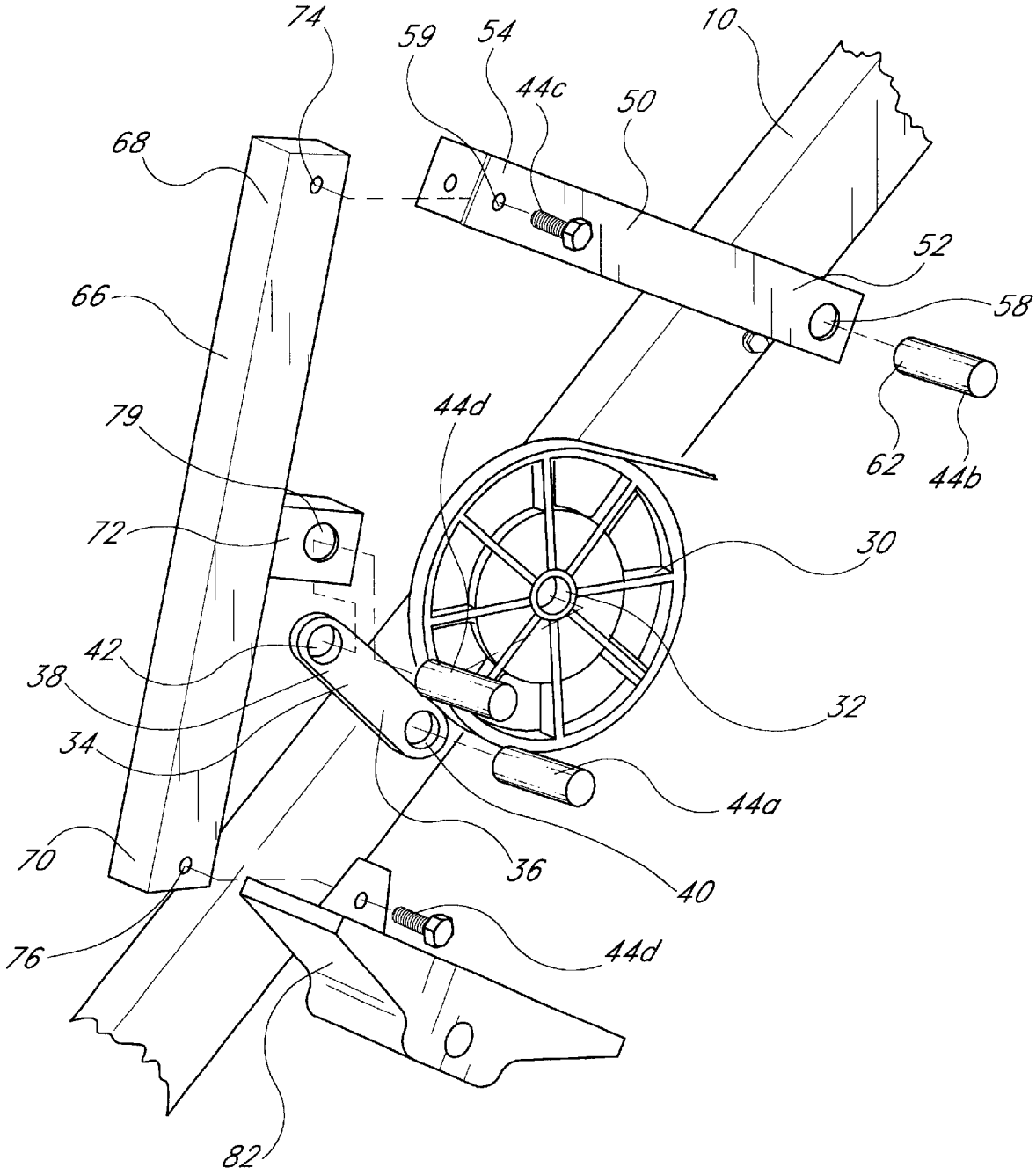
FIG. 4 is a detail exploded view of a preferred linkage assembly of the exercise machine of FIG. 2.

FIGS. 2–3 are perspective views of a deep stride elliptical exercise machine having features in accordance with another preferred embodiment of the present invention. Again, the machine 2 generally comprises a frame 10, a pair of guide linkages 50, 64 a pair of articulating linkages 66, 80, and a pair of foot members 82, 108. The frame 10 is configured to be supported by a substantially planar support surface, such as a floor. Guide linkages 50, 64 are pivotably secured to the frame 10, as shown. Linkages 66 and 80 are pivotably connected to the ends of each of the linkages 50, 64, respectively. A portio of each linkage 66, 80 extends from approximately the middle and pivotably connects the linkage 66, 80 to a crank 13. Foot members 82, 108 depend from each linkage 66, 80 and are pivotably secured thereto, as shown, so as to provide a range of rocking motion.

First and second cranks 30, 46 are rotatably connected to the frame 10. A first and second guide linkage 50, 64 is also pivotally connected to the frame 10. A first and second articulating linkage 66, 80 is pivotally connected to the guide linkages and a first and second crank arm 34, 48, respectively. A first and second foot member 82, 108 is pivotally connected to the articulating linkages 66, 80. First and second crank arms 34, 48 are coupled to a first and second flywheel 132, 138 which imparts resistance force to the foot members 82, 108. By this design, the foot members 82, 108 guide the feet of the exerciser along a preferred deep, anatomically natural running motion.

The first guide linkage 50, articulating linkage 66, and foot member 82 form a first assembly and the second guide linkage 64, articulating linkage 66, and foot member 108 form a second assembly. FIGS. 2 and 3 show that the first and second assemblies are preferably generally symmetrical and differ chiefly in position or phase relative to one another or to the frame 10. That is, the first assembly is arranged laterally toward a first side 16 of the frame and the second assembly is arranged laterally toward the second side 18 of the frame and 180° apart. Thus, it is understood that the first and second assemblies are generally similar in construction and design.

To assist in the description of the components of the exercise machine 2, the following coordinate terms are used. Referring to FIGS. 2 and 3, a longitudinal axis, X—X, extends generally along the depth of the exercise machine, from a proximal end of the machine to a distal end of the machine. A transverse axis, Y—Y, is generally perpendicular to the longitudinal axis and extends along the height of the exercise machine, and normal to the ground. A lateral axis Z—Z extends normal to both the longitudinal and transverse axes and along the width of the machine from a first side of the machine to a second side of the machine. The terms "proximal" and "distal" are used in reference to the entrance to the exercise machine, "proximal" being the open end where the user mounts the machine and "distal" being the closed, opposite end.

Referring to FIGS. 2–5, the frame 10 includes a proximal end 12 and a distal end 14 arranged generally along the X—X axis, and a first side 16 and a second side 18 arranged generally along the Z—Z axis. A plurality of elongated members form base members 20 which are supported by a generally planar support surface, such as a floor. The illustrated embodiment shows the base members 20 arranged in a rectangular manner, but the base members 20 may be arranged in a variety of other configurations giving due consideration of the goal of providing stability to the exercise machine 2 and minimizing the footprint of the exercise machine 2.

The frame 10 also includes at least one elongated member formed as a transverse member 22. The transverse member 22 preferably extends from the base members 20 and has a directional component along the Z—Z axis. The illustrated embodiments show a plurality of transverse members 22. The transverse members 22 may be used to further comprise the frame, interconnect elongated members, and provide additional support for the frame. Like the transverse members, lateral members may be used with the frame.

A first pivot axis X' and a second pivot axis X" are formed on the frame 10. The pivot axes X', X" are arranged so that elements that pivot therefrom (detailed below) are not inhibited from freely pivoting about the pivot axes X', X". A first crank 30 is secured to the first side 16 of the frame 10 along the first pivot axis X'. Preferably, the crank 30 forms a wheel having a central aperture 32. A first crank arm 34 is formed as an elongated member with a first end 36 and a second end 38. A first opening 40 and a second opening 42 are respectively formed toward the first and second ends 36, 38 of the crank arm 32.

The crank 30 and crank arm 34 are rotatably secured to the frame 10 by a coupling member 44*a*. The coupling member 44*a* extends along the first pivot axis X' through the first opening 40 in the crank arm 34, through the central aperture 32 of the crank 30 and through the first side 16 of the frame 10. The coupling member 44*a* rotatably secures the crank 30 and crank arm 34 so that the crank 30 and the crank arm 34 may rotate about the first pivot axis X'. Similarly, a second crank 46 and a second crank arm 48 are rotatably secured to the second side 18 of the frame 10 so that the second crank 46 and second crank arm 48 may rotate about the first pivot axis X'. A first guide linkage 50 is formed by an elongated member.

The first guide linkage 50 has first end 52 and a second end 54 with a first opening 58 and a second opening 59 formed toward the respective ends. The first end 52 of the guide linkage 50 is pivotally connected to the second pivot axis X" along the first side 16 of the frame 10 by a coupling member 44*b*. The coupling member 44*b* passes through the first opening 58 in the guide linkage 50 to rotatably secure the first guide linkage 50 to the first side 16 of the frame 10 so that the guide linkage 50 may rotate about the second pivot axis X". The coupling member 44*b* preferably has a length sufficient to laterally space apart the guide linkage 50 from the frame 10.

Preferably, a stationary washer 60, or other suitable element, is located toward an end 62 of the coupling member 44*b* to laterally space apart the guide linkage 50 from the frame 10. The washer 60 inhibits migration of the guide linkage 50 toward the frame 10. Interaction between the washer 60 and coupling member 44*b* may be performed in a variety of ways to accomplish the desired function of inhibiting migration of the guide linkage 50 toward the frame 10, such as using a washer 60 that is formed unitary with the coupling member 44*b*, or forming the washer and coupling member as separate elements which cooperate through a cotter pin or grooved shaft. The illustrated embodiment shows the washer 60 integrally formed with the coupling member. Similarly, a second guide linkage 64 is rotatably affixed to the second side 18 of the frame 10 so that the second guide linkage 64 may rotate about the second pivot axis X".

A first articulating linkage 66 is formed by an elongated member. The articulating linkage 66 has a first end 68 and a second end 70. A protuberance 72 is formed between the first end 68 and the second end 70. Openings 74, 76, 79, are respectively formed on the first articulating linkage 66 toward the first end 68, the second end 70 and the protuberance 72. The first end 68 of the articulating linkage 66 is pivotally connected to the second end 54 of the guide linkage 50 by a coupling member 44*c*. The coupling member 44*c* passes through the opening 74 in the first end 68 of the articulating linkage 66 and the opening 59 in the second end 54 of the guide linkage 50. The protuberance 72 on the first articulating linkage 66 rotatably engages the second end 38 of the crank arm 30 by another coupling member 44*d*. The coupling member 44*d* passes through the opening 79 in the protuberance 72 and the opening 42 in the second end 38 of the crank arm 30. A second articulating linkage 80 is similarly rotatably affixed to the second guide linkage 64 so that the second articulating linkage 80 can rotate with the second guide linkage 64.

A first foot member 82 is sized and shaped to support a foot of the user. The first foot member 82 can preferably pivot along the X—X axis so that the proximal and distal ends can pivot in either an upward or downward direction. This pivoting movement reduces stress on the ankles and knees of a user which may otherwise result from changes in orientation of the path of travel as the feet of the user is guided by the foot member 82. The pivoting movement also helps accommodate users of different heights. In the illustrated embodiment, the first foot member 82 is formed as a unitary member that can pivot without being inhibited. That is, the foot member 82 can pivot 360° in either direction. A coupling member 44*d* pivotally connects the first foot member 82 to the second end 70 or the articulating linkage 66. A second foot member 102 is similarly coupled to the second articulating linkage 80 so that the second foot member 102 can pivot with the second articulating linkage 80.

The first and second foot members 82, 108 are preferably 180° out of phase with one another. That is, when the first foot member 82 begins forward movement the second foot member 102 is begins rearward movement, and when the first foot member 82 begins vertically upward movement the second foot member 108 begins vertically downward movement. However, there is no requirement that the foot members be 180° out of phase. Rather, the foot members 82, 108 may also be independent or substantially of each other so as to adapt to a particular exerciser 6. An elongated rod 110 extends along the Z—Z axis proximate the distal end 14 of the frame 10. The rod 110 is preferably fixedly attached to the first and second sides 16, 18 of the frame 10 by a suitable bracket (not shown) or similar retention device. The rod 110 has a first gear 114 formed thereon. A transmission device, preferably a belt 116, but which can also be a cable, chain, rope or the like forms a closed loop around the first crank 30 and the first gear 114. The belt 116 mechanically transfers rotational motion imparted by the exerciser 6 to the foot members 82, 102 into circular motion onto the rod 110. Advantageously, the outer surface of the crank 30 and the outer surface of the gear forms ridges, or teeth (not shown), to reduce belt 116 slippage. Similarly, the inner surface of the belt 116 preferably has teeth (not shown) to reduce belt slippage.

An adjustable guide element 118 can be positioned between the gear 114 and crank 30 to adjust the tension and prevent tangling of the belt 116. If used, the guide element preferably comprises a roller with a grooved track (not shown) to guide the belt 116. The roller is secured to the frame 10 by a suitable adjustable bracket 124. FIG. 3 shows a second gear 114 is similarly formed on the rod 110 and coupled to the second crank 46 by a second belt 116. A first flywheel 132 is attached to the elongated rod 110 toward the first side 16 of the frame 10. The flywheel 132 is arranged so that rotation of the rod 110 causes rotation of the flywheel 132. A transmission device, preferably a second belt 134, couples the flywheel 132 to a load (not shown). A second flywheel 138 is similarly attached to the elongated rod 110 toward the second side 18 of the frame 10.

In each of the embodiments discussed above, the right and left gear trains are preferably coupled to a resistance device and/or a motor. This may be a common or shared resistance device and/or motor or they may be separate with each gear train having its own resistance device and/or motor. Any one of a variety of well known resistance devices and/or motors may be used, such as friction belts, fans, electric motors/generators and the like. Most preferably an electronically controlled motor/generator is used to provide variable mode operation between active (user driven) and passive (motor driven) exercise modes. Such a system is disclosed and described, for example, in U.S. Pat. No. 5,195,935 incorporated herein by reference.

If a shared resistance device and/or motor is used then the shaft 110 may be aptly sized and configured to connect the left side gear train to the right side gear train, as shown in FIGS. 2 and 3, so that the foot pedals are preferably maintained 180° apart. A suitable drive gear or pulley (not shown) may then be provided on the shaft 48 to couple both gear trains to a common resistance device.

Alternatively, the two gear trains (right and left) may be maintained entirely or partially independent from one another. In that case other synchronizing means, such as internal or external gearing or regulators, may be used to coordinate or synchronize the foot pedals as desired. For example, electronic control circuitry associated with each resistance device or motor may alternately be used to vary the drive or load on each gear train to attain a desired synchronization between the right and left gear trains. Such synchronization may either be constant or variable throughout the stride path, as desired, to provide the most effective and beneficial stride motion.

If the machine is used as a rehabilitation or flexibility device to impart a preferred anatomical motion to the exerciser, a power source, such as a motor is preferably coupled to the flywheel. The power source can thus provide a motive force onto the crank which, in turn, provides a motive force to the foot members so that the foot members can guide and direct a user's feet along the preferred anatomical path.

In operation, the user steps into the exercise machine 10 through the proximal end 14 of the frame 10 between the first and second foot members 82, 108. The user can then place a foot on the first foot member 82 when the first foot member 82 is at position A. Position A is an exemplary starting position in which the foot member 82 is substantially horizontal to the floor, thereby allowing the exerciser 6 to simply and easily step onto the foot member 82 and into the machine 2. However, the user need not enter through the proximal end of the frame or start at position A, which is only described as an example of one simple and easy starting methodology.

As the exerciser's weight transfers to the exercise machine 2, the first foot member 82 begins to vertically descend. As the first foot member 82 descends, the first articulating linkage 66 also vertically descends. The descent of the first articulating linkage 66 is guided by the first crank arm 34 and the first guide linkage 50 which are both pivotally connected to the first articulating linkage 66. As the first foot member 82 begins to vertically descend, the second foot member 108, which is preferably out of phase with the first foot member 82, begins to vertically ascend. Cardiovascular exercise is accomplished by continuing the foot motion along the path of travel.

Figure 5:
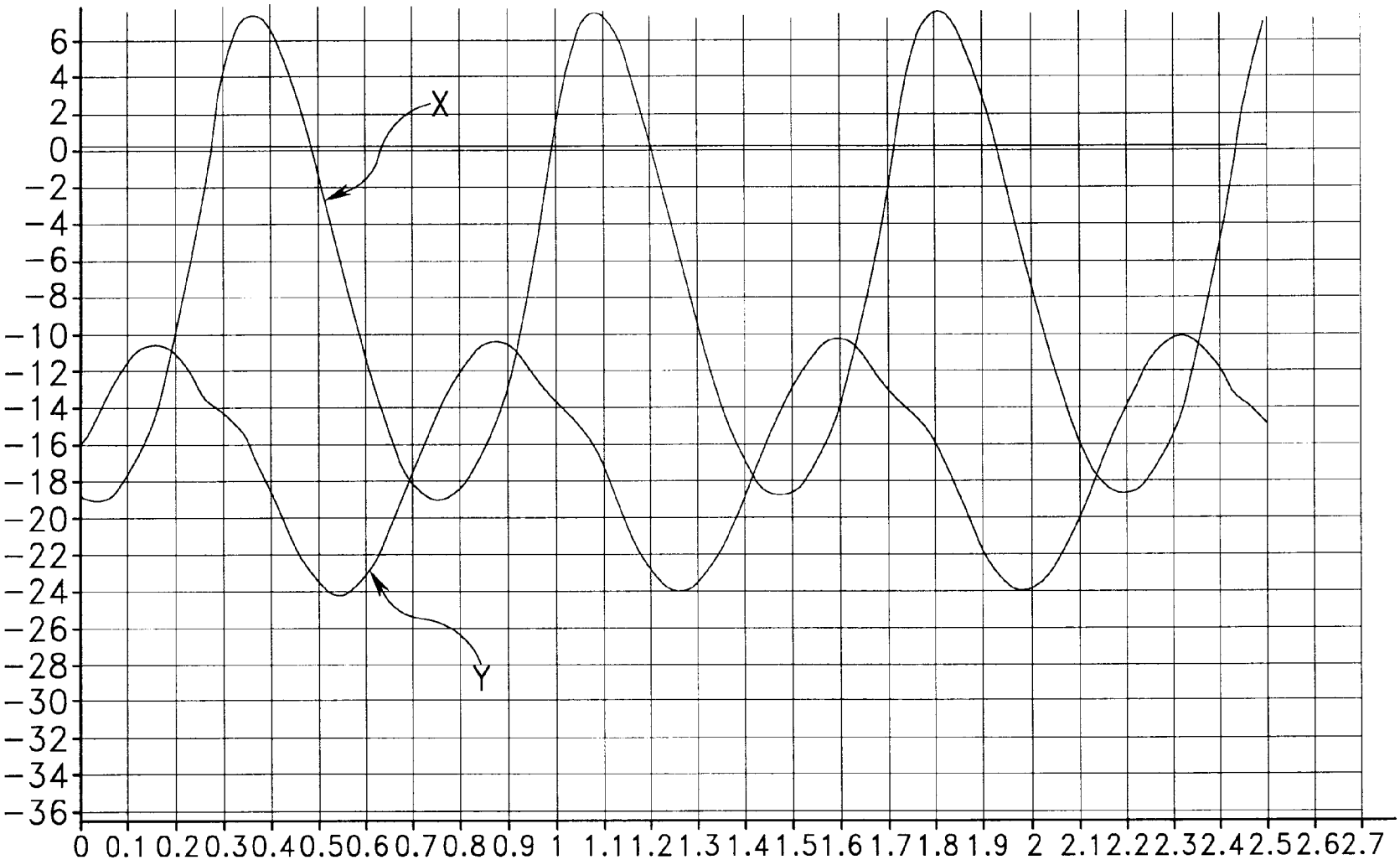
FIG. 5 is a graph of horizontal (X) and vertical (Y) displacement of a user's foot following a preferred deep stride foot path.

FIG. 5 is a graph of foot-pedal displacement of the exercise device of FIG. 1 in both the X and Y directions. As shown, the foot-pedal displacement "x" in the X direction (stride length) follows a substantially smooth generally sinusoidal path from about −19 inches at the beginning of each cycle at t=0, 0.75, 1.50 and 2.25 seconds, to about +7.5 inches at the end of each first half-cycle at t=0.40, 1.10 and 1.80 seconds. The foot-pedal displacement "y" in the Y direction (stride height) similarly follows a substantially smooth generally sinusoidal path between peak amplitudes of about −10.5 inches and about −24 inches.

Figure 6:
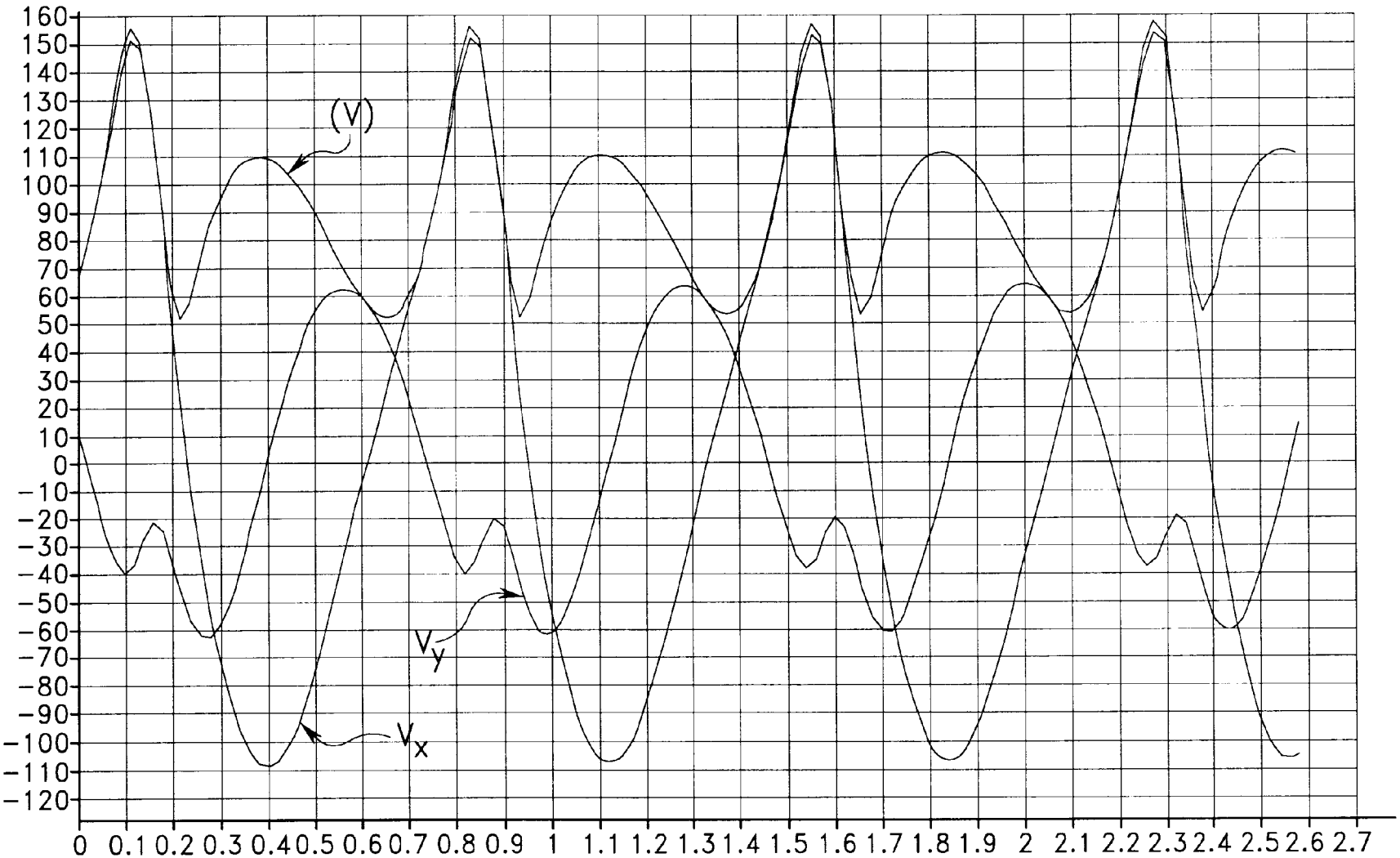
FIG. 6 is a graph of horizontal (X) and vertical (Y) velocity of a user's foot following a preferred deep stride foot path.

FIG. 6 is a graph of foot-pedal velocity of the exercise device of FIG. 1 in both the X and Y directions. As shown, the foot-pedal velocity $V_x$ in the X direction (stride length) follows a generally smooth sinusoidal path between peak amplitudes of about 155 in./sec and about −110 in./sec. The foot-pedal velocity $V_y$ in the Y direction (stride height) follows a generally smooth sinusoidal path between peak amplitudes of about 61 in./sec and about −61 in./sec. The absolute velocity |V| follows a substantially smooth and continuous roughly sinusoidal path between peak amplitudes of about +155 in./sec and about +51 in./sec.

Figure 7:
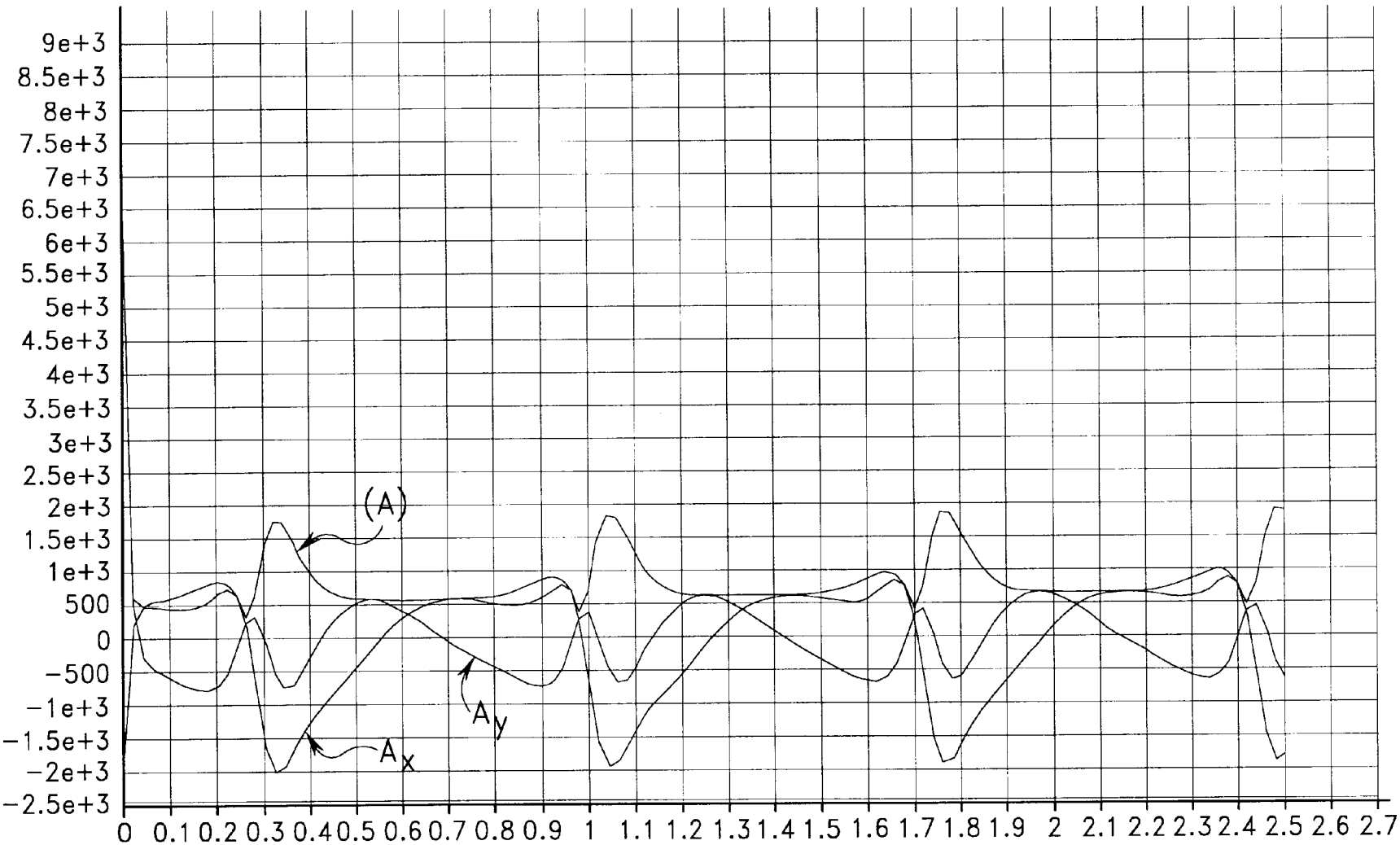
FIG. 7 is a graph of horizontal (X) and vertical (Y) acceleration of a user's foot following a preferred deep stride foot path.

FIG. 7 is a graph of foot-pedal acceleration of the exercise device of FIG. 1 in both the X and Y directions. As shown, the foot-pedal acceleration $A_x$ in the X direction (stride length) follows a generally smooth sinusoidal path between peak amplitudes of about −1750 in./sec$^2$ and about +1000 in./sec$^2$. The foot-pedal acceleration $A_y$ in the Y direction (stride height) follows a generally smooth sinusoidal path between peak amplitudes of about −600 in./sec$^2$ and about +750 in./sec$^2$. The absolute acceleration |A| follows a substantially smooth and continuous roughly sinusoidal path between peak amplitudes of about +1900 in./sec$^2$ and about −600 in./sec$^2$.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A lower body exercise machine, comprising:

a frame configured to be supported by a surface, the frame having a first and a second axis defined thereon;

a first and a second crank, the cranks rotatable about the first axis and having a crank arm; the cranks spaced part to accommodate apportion of a user therebetween;

a first and a second guide linkage having a first and a second end, the guide linkages pivotally connected to the frame at the second axis proximate the first end;

a first and a second articulating linkage having a first and a second end, the first end of the articulating linkages pivotally connected to the second end of the guide linkages proximate the first end, the second end of the articulating linkages connected to the crank arms between the first and second end such that the guide linkages pivot in an incomplete arc about the second axis when the guide linkages are connected to the frame and to the respective articulating linkages;

a first and a second foot member, the foot members connected proximate the second end of the articulating linkages;

a generally transverse plane generally defined by the first axis and the second axis;

whereby the foot members guide the feet of a user along a preferred anatomical running motion that has a generally kidney bean shape with a larger diameter end and a smaller diameter end and the generally transverse plane extending through said larger diameter end.

2. An exercise machine comprising a frame, a first input assembly and a second input assembly, said first input assembly and said frame comprising a first four bar linkage and said second input assembly and said frame comprising a second four bar linkage, said first four bar linkage consisting of a first articulating link, a first crank link, a first guide link and said frame, said second four bar linkage consisting of a second articulating link, a second crank link, a second guide link and said frame, said first crank link and said second crank link being connected to said frame at a first axis, said first guide link and said second guide link being connected to said frame about a second axis, said first axis being generally vertically lower than and generally rearward of said second axis, said first articulating member connecting said first guide link and said first crank link and said second articulating member connecting said second guide link and said second crank link, said first crank link and said second crank link being operatively connected to an elongated rod such that movement of said first crank link and said second crank link are interrelated, said first articulating member being connected to a first foot member and said second articulating member being connected to a second foot member such that displacing said first foot member and said second foot member results in movement of a user's feet about a preferred anatomical running pattern that is intersected by a plane extending through said first axis and said second axis.

3. The exercise machine of claim 2, wherein said elongate rod carries a first input gear and a second input gear, said first crank link is connected to a first crank and said second crank link is connected to a second crank link, said first input gear and said first crank being connected with a first belt and said second input gear and said second crank being connected with a second belt.

4. An exercise machine comprising a frame defining a first axis and a second axis, said first axis being generally vertically lower than said second axis a first and second crank mounted to said frame and rotatable about said first axis, a first guide linkage and a second guide linkage being mounted to said frame at said second axis and said first guide linkage and said second guide linkage being rotatable about said second axis;

a first articulating linkage being pivotally secured to said first guide linkage and a second articulating linkage being pivotally secured to said second guide linkage, said first articulating linkage and said second articulating linkage being rotationally secured to said crank in a medial location;

a first foot member being secured to said first articulating linkage and a second foot member being secured to said second articulating linkage;

said first foot member and said second foot member each guiding a foot of a user along an elliptical path, whereby the user can stride through said first axis during use.

5. The exercise machine of claim 4 further comprising a first armrest and a second armrest that provide support to one or more upper body parts of a user.

6. The exercise machine of claim 4 wherein said elliptical path comprises an overall vertical displacement that is between about one half and about two thirds of an overall horizontal displacement per cycle.

7. The exercise machine of claim 4 further comprising a resistance component that is operationally connected to said crank and that is sized and configured to provide resistance to said first and second foot members.

8. The exercise machine of claim 4, further comprising an electronic user interface.

9. The exercise machine of claim 8, wherein the electronic user interface provide for a user selected amount of resistance.

10. The exercise machine of claim 8, wherein the electronic user interface provide for a user selected exercise time duration.

* * * * *

UNITED STATES PATENT AND TRADEMARK OFFICE

CERTIFICATE OF CORRECTION

PATENT NO. : 6,551,218 B2
DATED : April 22, 2003
INVENTOR(S) : Yong-Ming Goh

It is certified that error appears in the above-identified patent and that said Letters Patent is hereby corrected as shown below:

Title page,
Item [75], Inventor, should read -- Yong-Ming Goh, Laverne, CA (US) --

Signed and Sealed this

Seventh Day of October, 2003

JAMES E. ROGAN
*Director of the United States Patent and Trademark Office*